US006423111B1

(12) United States Patent
Nishikita et al.

(10) Patent No.: US 6,423,111 B1
(45) Date of Patent: Jul. 23, 2002

(54) BALL FOR BALL-POINT PEN

(75) Inventors: Kazuyuki Nishikita; Hideji Yoshida, both of Nara-ken (JP)

(73) Assignee: Tsubaki Nakashima Co., Ltd., Nara-ken (JP)

( * ) Notice: Subject to any disclaimer, the term of this patent is extended or adjusted under 35 U.S.C. 154(b) by 0 days.

(21) Appl. No.: 09/832,696

(22) Filed: Apr. 11, 2001

(51) Int. Cl.[7] ..... C22C 29/02
(52) U.S. Cl. ..... 75/239; 75/240
(58) Field of Search ..... 75/239, 240

(56) References Cited

U.S. PATENT DOCUMENTS 3,503,692 A * 3/1970 Kubota et al.
3,746,456 A * 7/1973 Hill
4,182,627 A * 1/1980 Hardwick
5,421,852 A * 6/1995 Maruyama et al. ..... 75/239
5,841,045 A * 11/1998 McCandlish et al. ..... 75/236
5,885,372 A * 3/1999 Seegopaul ..... 148/237
6,322,728 B1 * 12/2001 Ito et al. ..... 401/215

OTHER PUBLICATIONS

Abstract publication No. JP 75031049B.*

* cited by examiner

*Primary Examiner*—Ngoclan Mai
(74) *Attorney, Agent, or Firm*—Duane Morris LLP

(57) ABSTRACT

A ball for a ball-point pen is provided comprising cemented carbide of WC—$Cr_3C_2$—Co where VC is contained as a solid solution in the $Cr_3C_2$—CO phase which is a binder of WC particles and wherein the mean diameter of the WC particles is in the range of from about 0.3 to about 0.5 $\mu$m. In one embodiment of the invention, a portion of the $Cr_3C_2$—VC—CO phase exposed on the surface of the ball comprises a plurality of concave recesses.

2 Claims, 4 Drawing Sheets

BALL FOR BALL-POINT PEN

FIELD OF THE INVENTION

The present invention generally relates to ball-point pens, and more particularly to the balls for ball-point pens.

BACKGROUND OF THE INVENTION

In Japanese Patent Publication No. 31049/1975, a ball for a ball-point pen is disclosed which comprises cemented carbide, e.g., WC—$Cr_3C_2$—Co. Such cemented carbide "balls" are well known in the writing implement arts, and often have a diameter in the range of 0.3–1.0 mm. Tables 1 and 2 show typical characteristics of known balls next to typical characteristics of balls formed according to the invention, having compositions, hardness, and mean diameter of WC particles for satisfying such design requirements as wear resistance, corrosion resistance to ink, and "wetting relationship" between the ink and the ball, referred to as "spreadability" of the ink. To put it correctly, conventional examples in Tables 1 and 2, represent characteristics of balls intended for use with oil base ink and water base ink, respectively.

The use of inks consisting of high viscosity gel that is capable of fully dispersing heavy and hard inorganic pigments (e.g., titania and zinc white, etc.) is increasing. When conventional balls, of the types characterized in Tables 1 and 2, are used with gel ink of a high viscosity and comprising hard inorganic pigments, portions exposed on the ball surface of the $Cr_3C_2$—Co phase (which is a binder of the WC particles) are worn severely. In many cases, as a result of this severe wear, the WC particles drop out of their locations on the surface of the ball. These loose WC particles tend to act as an abrasive or polisher. As a result, the main body of the pen-point is often significantly worn down by the abrasive action of these loose WC particles. Consequently, the ball sinks into the main body of pen-point, giving rise to the following problems:

(1) ink does not flow out easily as the ink grooves formed in the main body of the pen-point are blocked;

(2) frictional resistance increases as the contact area between the ball and the main body of the pen-point increases, thereby making it difficult for the ball to roll properly; and (3) unless the ball-point pen is utilized in a substantially upright position, the ball holding section of the main body of the pen-point engages the paper, causing the pen-point to be scratchy, i.e., the angle between the paper and the ball-point pen which allows writing without causing the pen-point to be scratchy becomes larger. Moreover, as the angle becomes larger, it becomes increasingly difficult for the ink to be dispensed from the pen-point.

The above-mentioned problems result in the writing performance of the ball-point pen worsening at an early stage, because the main body of pen-point wears out quickly. This is particularly true with the conventional balls characterized in Tables 1 and 2.

In addition, the mean diameter of the WC particles exposed on the surface of the ball is relatively large in the conventional balls characterized in Table 2. Here, the surface area of the $CrSC_2$—CO phase, which controls the "spreadability" of the ink, is relatively small. This results in poor "spreadability" of the ink, causing the written lines to be broken or uneven. This poor performance is increased when such prior art balls are used in combination with high viscosity gel inks containing heavy and hard inorganic pigments.

SUMMARY OF THE INVENTION

The present invention solves these and other problems in the art by providing a ball for a ball-point pen which is capable of reducing wear on the main body of the pen-point of a conventional ball-point pen thereby maintaining good writing performance for a longer term, even if high viscosity gel inks with heavy and hard inorganic pigments are employed. The present invention provides a ball for a ball-point pen comprising cemented carbide of WC—$Cr_3C_2$—Co wherein VC exists as solid solution in the $Cr_3C_2$—Co phase which is a binder of WC particles and the mean diameter of the WC particles is in the range of from about 0.3 to about 0.5 $\mu$m. In a preferred embodiment of the invention, the surface of the ball which includes a portion of the $Cr_3C_2$—VC—Co phase is formed so as to include a plurality of concave recesses.

A ball formed in accordance with the preferred embodiments of the invention will at least include characteristics such as:

(1) hardness increases, because the WC particles are bonded in a more "dense" state than with prior art ballpoint pen balls; and therefore wear and abrasion resistance improves;

(2) the mean diameter of the WC particles exposed on the surface of the ball is smaller than that of the prior art, with the surface area of the $Cr_3C_2$—VC—Co phase being greater, therefore, even if high viscosity gel inks including heavy and hard inorganic pigments are used, the following effects may be achieved:

(a) the WC particles will not drop out easily. Moreover, even if the particles drop out of the ball, the wear on the main body of pen-point will be reduced, because the mean diameter of the particles is relatively small; and (b) the "spreadability" of the ink is significantly improved such that the written line will not get broken or uneven.

In addition, since a portion of the exposed surface of the ball having a $Cr_3C_2$—VC—Co phase is concavely formed, the writing performance is improved because the ball will roll with the ink maintained within the plurality of concave recesses formed on the surface of the ball.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
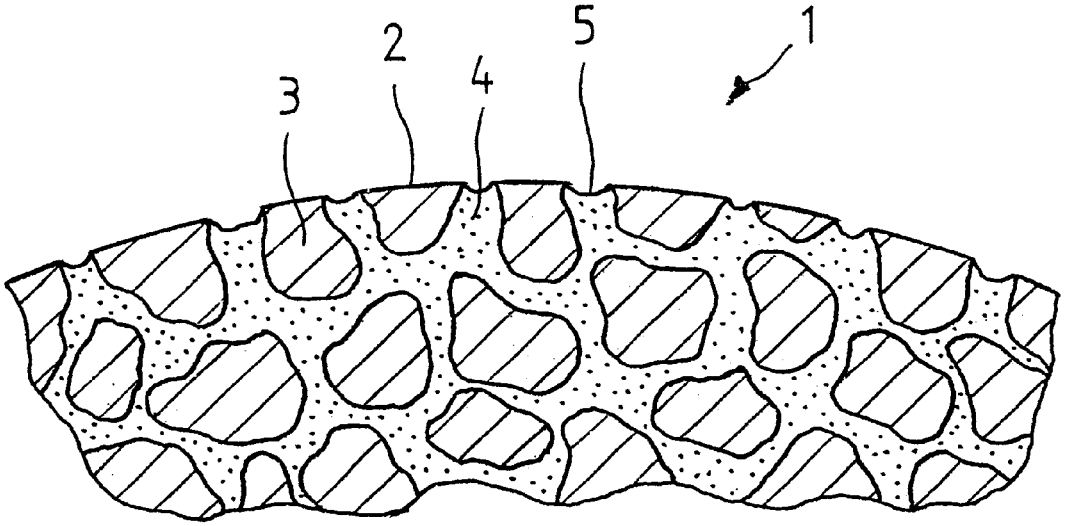
FIG. 1 is an enlarged sectional view of the principal part of the ball of the present invention.

This description of preferred embodiments is intended to be read in connection with the accompanying drawings, which are to be considered part of the entire written description of this invention. The structure of the main body of a conventional ball point pen-point in which a ball formed according to the present invention is to be positioned will be well-known to those skilled in the art, and therefore a detailed description is not being provided here. Referring to FIG. 1, ball 1 comprises WC particles 3 of about 0.3 to about 0.5 $\mu$m mean diameter. A $Cr_3C_2$—VC—CO phase 4 acts as a binder for the WC particles 3.

The portion of the $Cr_3C_2$—VC—Co phase 4 exposed on the surface of ball 1 includes a plurality of concave recesses 5 in which ink (e.g., high viscosity gel inks including heavy and hard inorganic pigments, not shown) will be held during writing with the ball-point pen.

Ball 1 is formed from a precursor ball (not shown) of the composition, hardness and the WC particle mean diameter as shown in Table 1 and Table 2. Such a precursor ball is obtained in a known manner, e.g., by sintering powder material comprising WC, Co and $Cr_3C_2$ added with an effective amount of Vanadium Carbide.

From this precursor ball, a ball 1 is formed from a known lapping process (e.g., a mesh of diamond powder gradually reduced) so as to comprise a mirror-like surface 2, with a predetermined size tolerance and sphericity. Thereafter, ball 1 is soaked with a red prussiate alkali solution, known in the art as Mr. Murakami's solution, so as to cause corrosion; or it may be polished with diamond powder, which is somewhat more coarse than that used in the above-mentioned lapping process, so that the plurality of concave recesses 5 may be formed in the surface of the $Cr_3C_2$—VC—Co phase 4.

Figure 2:
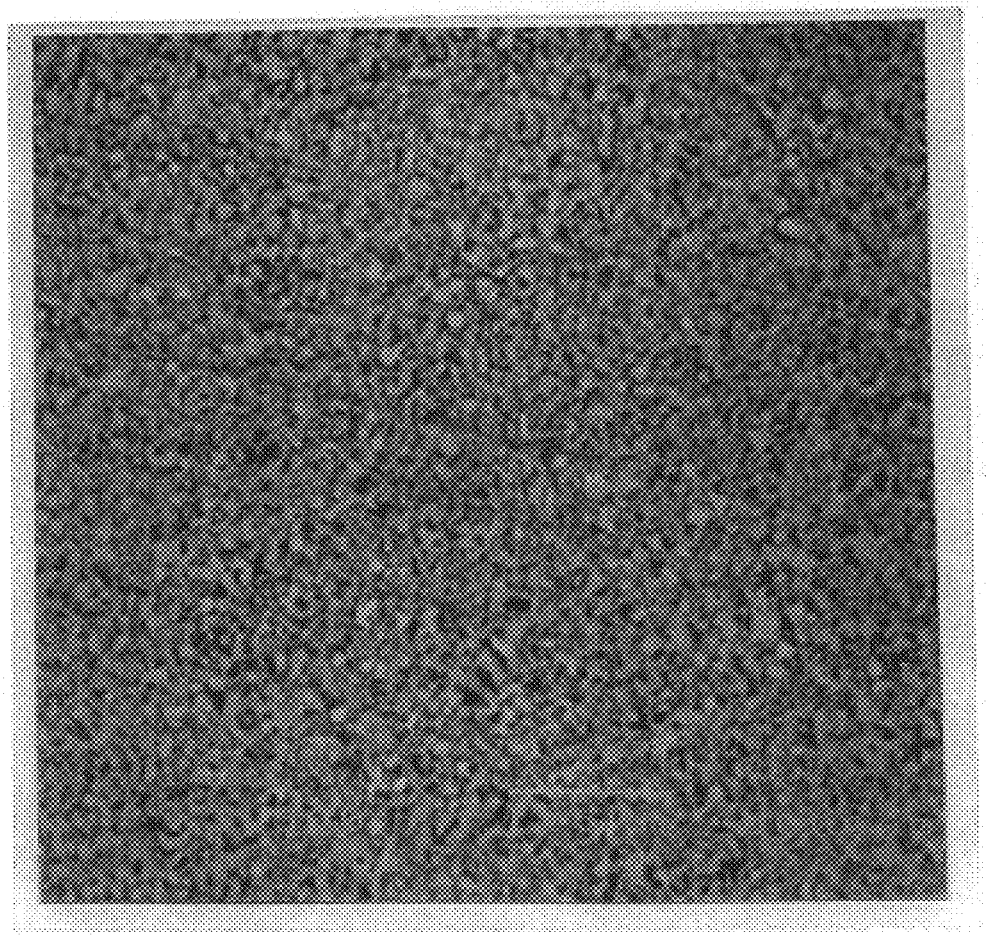
FIG. 2 is a photographic representation of the microscopic structure of the ball of the present invention characterized in Tables 1 and 2.
Figure 3:
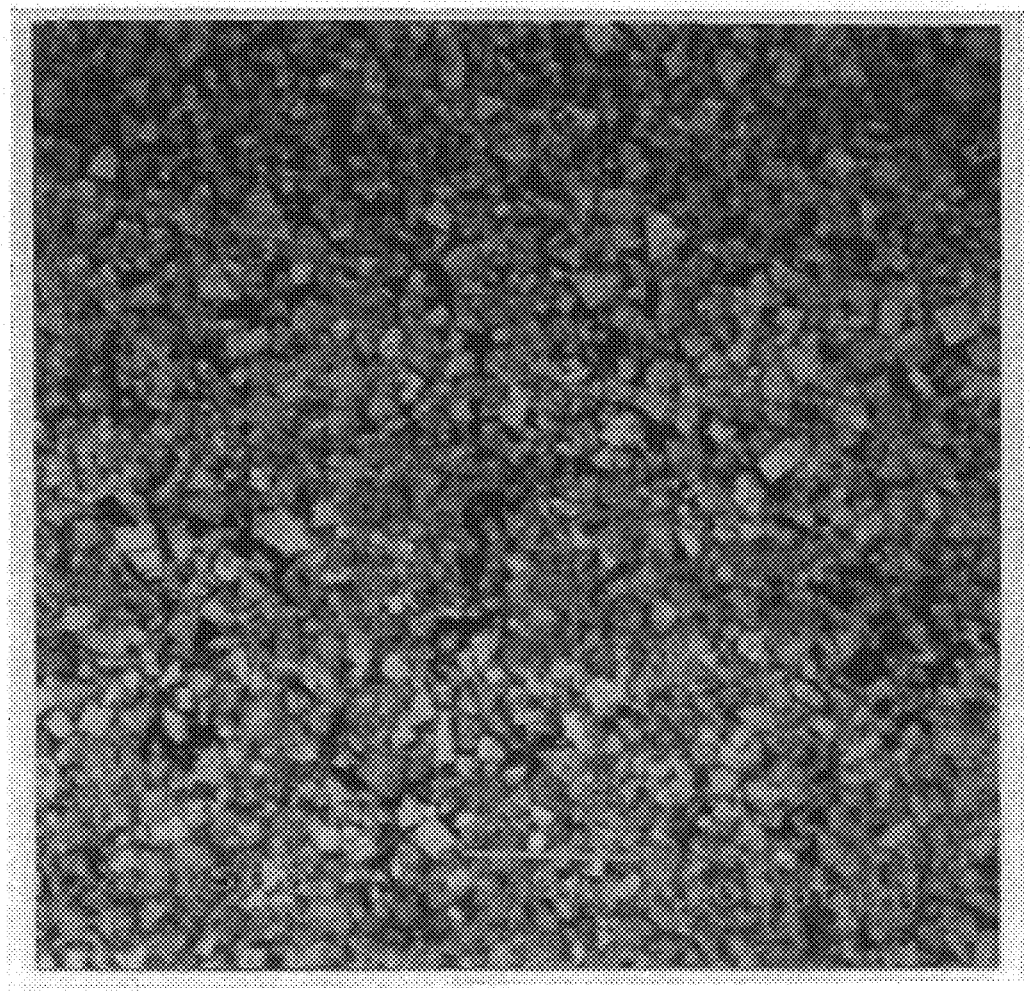
FIG. 3 is a photographic representation of the microscopic structure of the ball of the conventional example 1 characterized in Tables 1 and 2.
Figure 4:
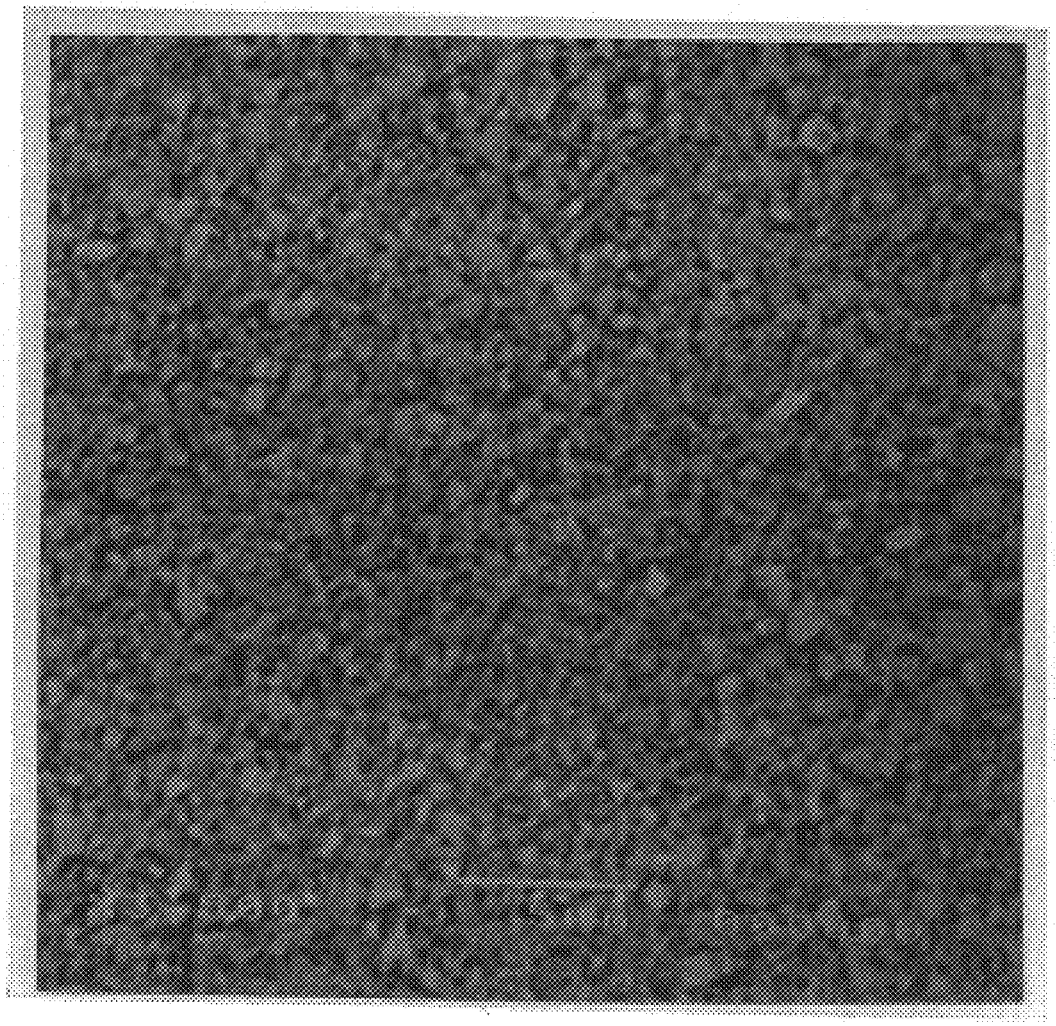
FIG. 4 is a photographic representation of the microscopic structure of the ball of the conventional example 2 characterized in Tables 1 and 2.

The reason why Vanadium Carbide is added to the powder material comprising WC, Co and $Cr_3C_2$ is to obtain WC particles having relatively small mean diameter by restricting crystal growth (see Tables 1 and 2). The microscopic structures (taken by SEM at ×3,500) of ball 1, a ball of conventional example 1 and a ball of conventional example 2 are shown in FIGS. 2 to 4, respectively. It is also possible to adjust the mean diameter of the WC particles to 0.2 $\mu$m or less; but it is not practicable due to the problems relating to the strength.

ADVANTAGES OF THE INVENTION

Numerous advantages are obtained by employing the present invention as explained above.

(1) Hardness increases because the WC particles are bonded in a more "dense" state than with prior art ballpoint pen balls, therefore wear and abrasion resistance improves.

(2) The mean diameter of the WC particles exposed on the surface of the ball is smaller than that of the prior art. That is, the surface area of the $Cr_3C_2$—VC—Co phase is greater. Therefore, even if high viscosity get inks with the heavy and hard inorganic pigments are used, the following effects may be achieved:

① The WC particles will not drop out easily. Moreover, even if the particles drop out, the wear of the main body of pen-point is reduced, because the mean diameter of the particles is relatively small; and ② The "spreadability" of the ink is more improved over prior art ball-point pen balls, so that the written line will not get broken or uneven.

In addition, if the portion of the $Cr_3C_2$—VC—CO phase exposed on the surface of the ball is formed so as to include a plurality of concave recesses, the writing performance of the pen is further improved, because the ball will roll with the ink maintained within the concavities.

It is to be understood that the present invention is by no means limited only to the particular constructions herein disclosed and shown in the drawings, but also comprises any modifications or equivalents within the scope of the claims.

TABLE 1

| | Composition (Weight %) | | | |
|---|---|---|---|---|
| | WC | Co | $Cr_3C_2$ | VC |
| Present Invention | 85.3 ± 1.5 | 10.0 ± 0.5 | 4.5 ± 0.5 | 0.2 ± 0.05 |
| Conv. Example 1 | 83.5 ± 1.5 | 12.0 ± 0.5 | 4.5 ± 0.5 | |
| Conv. Example 2 | 85.5 ± 1.5 | 10.0 ± 0.5 | 4.5 ± 0.5 | |

TABLE 2

| | Hardness (HRA) | Mean Diameter of the WC Particles ($\mu$m) |
|---|---|---|
| Present Invention | 93.0 ± 0.3 | 0.3~0.5 |
| Conv. Example 1 | 91.5 ± 0.3 | 1.0~4.5 |
| Conv. Example 2 | 92.5 ± 0.3 | 0.5~1.0 |

What is claimed is:

1. A ball for a ball-point pen comprising cemented carbide of WC—$Cr_3C_2$—CO wherein VC is contained as a solid solution in the $Cr_3C_2$—Co phase which is a binder of WC particles and wherein the mean diameter of said WC particles is in the range of from about 0.3 to about 0.5 $\mu$m.

2. A ball for a ball-point pen according to claim 1 wherein a portion of said $Cr_3C_2$—VC—CO phase exposed on the surface of said ball comprises a plurality of concave recesses.

* * * * *